US007314401B2

(12) United States Patent
Chandrasekaran

(10) Patent No.: US 7,314,401 B2
(45) Date of Patent: Jan. 1, 2008

(54) METHODS AND SYSTEMS FOR CONDITIONING PLANARIZING PADS USED IN PLANARIZING SUBSTRATES

(75) Inventor: Nagasubramaniyan Chandrasekaran, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 11/545,928

(22) Filed: Oct. 10, 2006

(65) Prior Publication Data

US 2007/0032171 A1 Feb. 8, 2007

Related U.S. Application Data

(62) Division of application No. 11/350,619, filed on Feb. 8, 2006, which is a division of application No. 10/228,154, filed on Aug. 26, 2002, now Pat. No. 7,011,566.

(51) Int. Cl.
*B24B 49/00* (2006.01)

(52) U.S. Cl. ..... 451/10; 451/11; 451/41; 451/287; 156/345.25; 156/345.28

(58) Field of Classification Search ..... 451/5, 451/9, 10, 11, 41, 56, 285, 287, 288; 156/345.16, 156/345.25, 345.28
See application file for complete search history.

(56) References Cited

U.S. PATENT DOCUMENTS 5,036,015 A 7/1991 Sandhu et al.
5,069,002 A 12/1991 Sandhu et al.
5,081,796 A 1/1992 Schultz
5,193,353 A 3/1993 Brendel et al.
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,421,769 A 6/1995 Schultz et al.
5,433,651 A 7/1995 Lustig et al.
5,449,314 A 9/1995 Meikle et al.
5,486,129 A 1/1996 Sandhu et al.

(Continued)

OTHER PUBLICATIONS

U.S. Appl. No. 11/479,623, filed Jun. 29, 2006, Chandrasekaran.

(Continued)

*Primary Examiner*—Eileen P. Morgan
(74) *Attorney, Agent, or Firm*—Perkins Coie LLP

(57) ABSTRACT

Monitoring the process of planarizing a workpiece, e.g., conditioning a CMP pad, can present some difficulties. Aspects of this invention provide methods and systems for monitoring and/or controlling such a planarization cycle. For example, a control system may monitor the proximity of a workpiece holder and an abrasion member by measuring the capacitance between a first sensor associated with the workpiece holder and a second sensor associated with the abrasion member. This exemplary control system may adjust a process parameter of the planarization cycle in response to a change in the measured capacitance. This can be useful in endpointing the planarization cycle, for example. In certain applications, the control system may define a pad profile based on multiple capacitance measurements and use the pad profile to achieve better planarity of the planarized surface.

12 Claims, 7 Drawing Sheets

U.S. PATENT DOCUMENTS 5,514,245 A 5/1996 Doan et al.
5,533,924 A 7/1996 Stroupe et al.
5,540,810 A 7/1996 Sandhu et al.
5,609,718 A 3/1997 Meikle
5,616,069 A 4/1997 Walker et al.
5,618,381 A 4/1997 Doan et al.
5,618,447 A 4/1997 Sandhu
5,643,060 A 7/1997 Sandhu et al.
5,645,682 A 7/1997 Skrovan
5,655,951 A 8/1997 Meikle et al.
5,658,183 A 8/1997 Sandhu et al.
5,658,190 A 8/1997 Wright et al.
5,663,797 A 9/1997 Sandhu
5,664,988 A 9/1997 Stroupe et al.
5,679,065 A 10/1997 Henderson
5,700,180 A 12/1997 Sandhu et al.
5,702,292 A 12/1997 Brunelli et al.
5,725,417 A 3/1998 Robinson
5,730,642 A 3/1998 Sandhu et al.
5,743,784 A 4/1998 Birang et al.
5,747,386 A 5/1998 Moore
5,779,522 A 7/1998 Walker et al.
5,782,675 A 7/1998 Southwick
5,792,709 A 8/1998 Robinson et al.
5,795,495 A 8/1998 Meikle
5,801,066 A 9/1998 Meikle
5,807,165 A 9/1998 Uzoh et al.
5,827,112 A 10/1998 Ball
5,830,806 A 11/1998 Hudson et al.
5,833,519 A 11/1998 Moore
5,842,909 A 12/1998 Sandhu et al.
5,846,336 A 12/1998 Skrovan
5,851,135 A 12/1998 Sandhu et al.
5,868,896 A 2/1999 Robinson et al.
5,879,226 A 3/1999 Robinson
5,882,248 A 3/1999 Wright et al.
5,893,754 A 4/1999 Robinson et al.
5,895,550 A 4/1999 Andreas
5,910,043 A 6/1999 Manzonie et al.
5,934,980 A 8/1999 Koos et al.
5,945,347 A 8/1999 Wright
5,954,912 A 9/1999 Moore
5,967,030 A 10/1999 Blalock
5,972,792 A 10/1999 Hudson
5,975,994 A 11/1999 Sandhu et al.
5,980,363 A 11/1999 Meikle et al.
5,981,396 A 11/1999 Robinson et al.
5,994,224 A 11/1999 Sandhu et al.
5,997,384 A 12/1999 Blalock
6,004,196 A 12/1999 Doan et al.
6,039,633 A 3/2000 Chopra
6,040,245 A 3/2000 Sandhu et al.
6,054,015 A 4/2000 Brunelli et al.
6,066,030 A 5/2000 Uzoh
6,074,286 A 6/2000 Ball
6,075,606 A 6/2000 Doan
6,083,085 A 7/2000 Lankford
6,110,820 A 8/2000 Sandhu et al.
6,116,988 A 9/2000 Ball
6,120,354 A 9/2000 Koos et al.
6,135,856 A 10/2000 Tjaden et al.
6,139,402 A 10/2000 Moore
6,143,123 A 11/2000 Robinson et al.
6,143,155 A 11/2000 Adams et al.
6,152,808 A 11/2000 Moore
6,176,992 B1 1/2001 Talieh
6,187,681 B1 2/2001 Moore
6,191,037 B1 2/2001 Robinson et al.
6,193,588 B1 2/2001 Carlson et al.
6,196,899 B1 3/2001 Chopra et al.
6,200,901 B1 3/2001 Hudson et al.
6,203,404 B1 3/2001 Joslyn et al.
6,203,407 B1 3/2001 Robinson
6,203,413 B1 3/2001 Skrovan
6,206,754 B1 3/2001 Moore
6,206,756 B1 3/2001 Chopra et al.
6,210,257 B1 4/2001 Carlson
6,213,845 B1 4/2001 Elledge
6,218,316 B1 4/2001 Marsh
6,220,934 B1 4/2001 Sharples et al.
6,224,466 B1 5/2001 Walker et al.
6,227,955 B1 5/2001 Custer et al.
6,234,874 B1 5/2001 Ball
6,234,877 B1 5/2001 Koos et al.
6,234,878 B1 5/2001 Moore
6,237,483 B1 5/2001 Blalock
6,238,270 B1 5/2001 Robinson
6,250,994 B1 6/2001 Chopra et al.
6,251,785 B1 6/2001 Wright
6,261,151 B1 7/2001 Sandhu et al.
6,261,163 B1 7/2001 Walker et al.
6,267,650 B1 7/2001 Hembree
6,273,786 B1 8/2001 Chopra et al.
6,273,796 B1 8/2001 Moore
6,273,800 B1 8/2001 Walker et al.
6,276,996 B1 8/2001 Chopra
6,306,008 B1 10/2001 Moore
6,306,012 B1 10/2001 Sabde
6,306,014 B1 10/2001 Walker et al.
6,306,768 B1 10/2001 Klein
6,312,558 B2 11/2001 Moore
6,313,038 B1 11/2001 Chopra et al.
6,328,632 B1 12/2001 Chopra
6,331,139 B2 12/2001 Walker et al.
6,331,488 B1 12/2001 Doan et al.
6,338,667 B2 1/2002 Sandhu et al.
6,350,180 B2 2/2002 Southwick
6,350,691 B1 2/2002 Lankford
6,352,466 B1 3/2002 Moore
6,352,470 B2 3/2002 Elledge
6,354,923 B1 3/2002 Lankford
6,354,930 B1 3/2002 Moore
6,358,122 B1 3/2002 Sabde et al.
6,358,127 B1 3/2002 Carlson et al.
6,358,129 B2 3/2002 Dow
6,361,411 B1 3/2002 Chopra et al.
6,361,413 B1 3/2002 Skrovan
6,361,417 B2 3/2002 Walker et al.
6,364,746 B2 4/2002 Moore
6,364,757 B2 4/2002 Moore
6,368,190 B1 4/2002 Easter et al.
6,368,193 B1 4/2002 Carlson et al.
6,368,194 B1 4/2002 Sharples et al.
6,368,197 B2 4/2002 Elledge
6,376,381 B1 4/2002 Sabde
6,447,369 B1 9/2002 Moore
6,609,947 B1 8/2003 Moore
6,612,901 B1 9/2003 Agarwal
6,689,258 B1 2/2004 Lansford et al.
6,702,646 B1 3/2004 Gitis et al.
7,011,566 B2 3/2006 Chandrasekaran
2006/0128273 A1 6/2006 Chandrasekaran
2006/0194515 A1 8/2006 Chandrasekaran

OTHER PUBLICATIONS

Bubnick, M. et al., "Impact of Diamond CMP CMP Conditioning Disk Characteristics on Removal Rates of Polyurethane Polishing Pads," 7 pages, http://www.abrasive-tech.com/pdf/cmp_rem.pdf, Abrasive Technology, Lewis Center, Ohio, Feb. 2002.

Kondo, S. et al., "Abrasive-Free Polishing for Copper Damascene Interconnection," *Journal of the Electrochemical Society*, 147 (10) 3907-3913 (2000), The Electrochemical Society, Inc., Pennington, New Jersey.

METHODS AND SYSTEMS FOR CONDITIONING PLANARIZING PADS USED IN PLANARIZING SUBSTRATES

CROSS-REFERENCE TO RELATED APPLICATIONS

This application is a divisional of U.S. patent application Ser. No. 11/350,619, filed Feb. 8, 2006, which is a divisional of U.S. patent application Ser. No. 10/228,154 filed Aug. 26, 2002, now U.S. Pat. No. 7,011,566 issued Mar. 14, 2006, both of which are incorporated herein by reference in their entireties.

BACKGROUND

The present invention provides certain improvements in planarizing workpieces. The invention has particular utility in connection with conditioning CMP pads, though it may also be used in other applications, such as in planarizing semiconductor wafers or other microelectronic workpieces.

Mechanical and chemical-mechanical planarizing processes (collectively "CMP processes") remove material from the surfaces of semiconductor wafers, field emission displays, or other microelectronic/workpieces in the production of microelectronic components and other products. FIG. 1 schematically illustrates a planarizing machine 10 with a circular table or platen 20, a first carrier assembly 30, a planarizing pad 40 having a planarizing surface 42, and a planarizing fluid 44 on the planarizing surface 42. The planarizing machine 10 may also have an under-pad 25 attached to an upper surface 22 of the plate 20 for supporting the planarizing pad 40. A drive assembly 26 rotates the platen 20 (indicated by arrow A) and/or reciprocates the platen 20 back and forth (indicated by arrow B). Since the planarizing pad 40 is attached to the under-pad 25, the planarizing pad 40 moves with the platen 20 during planarization.

The first carrier assembly 30 has a carrier head or substrate holder 32 with a pad 34 that holds the workpiece 12 to the carrier head 32. An actuator assembly 36 may be coupled to the carrier head 32 to impart axial and/or rotational motion to the carrier head 32 (indicated by arrows C and D, respectively). The carrier head 32, however, may be a weighted, free-floating disk (not shown) that slides over the polishing pad 40. The carrier head 32 may be coupled to a sweep actuator 33 by an arm 31. The sweep actuator 33 may rotate the arm 31 (indicated by arrow E) to reciprocate the carrier head 32 along an arcuate path across the planarizing surface 42.

The planarizing pad 40 and the planarizing solution 44 collectively define a planarizing medium that mechanically and/or chemically-mechanically removes material from the surface of the workpiece 12. The planarizing machine 10 can use a fixed-abrasive planarizing pad 40 having abrasive particles fixedly bonded to a suspension material. The planarizing solutions 44 used with fixed-abrasive pads are generally "clean solutions" without abrasive particles. In other applications, the planarizing pad 40 may be a non-abrasive pad composed of a polymeric material (e.g., polyurethane), a resin, felt, or other suitable material without abrasive particles. The planarizing solutions 44 used with nonabrasive polishing pads are typically abrasive slurries that contain abrasive particles suspended in a liquid.

If chemical-mechanical planarization (as opposed to plain mechanical planarization) is employed, the planarizing solution 44 will typically chemically interact with the surface of the workpiece 12 to speed up or otherwise optimize the removal of material from the surface of the workpiece. Increasingly, microelectronic device circuitry (i.e., trenches, vias, and the like) is being formed from copper. When planarizing a copper layer using a CMP process, the planarizing solution 44 is typically neutral to acidic and includes an oxidizer (e.g., hydrogen peroxide) to oxidize the copper and increase the copper removal rate. One particular slurry useful for polishing a copper layer is disclosed in International Publication Number WO 02/18099, the entirety of which is incorporated herein by reference.

To planarize the workpiece 12 with the CMP machine 10, the carrier assembly 30 presses the workpiece 12 face-downward against the polishing medium. More specifically, the carrier assembly 30 generally presses the workpiece 12 against the planarizing solution 44 on a planarizing surface 42 of the planarizing pad 40, and the platen 20 and/or the carrier assembly 30 move to rub the workpiece 12 against the planarizing surface 42. As the workpiece 12 rubs against the planarizing surface 42, material is removed from the face of the workpiece 12.

CMP processes should consistently and accurately produce a uniformly planar surface on the substrate assembly 12 to enable precise fabrication of circuits and photo-patterns. For example, during the fabrication of transistors, contacts, interconnects and other components, many substrate assemblies develop large "step heights" that create a highly topographic surface across the substrate assembly 12. To enable the fabrication of integrated circuits with high densities of components, it is necessary to produce a highly planar surface at several stages of processing the substrate assembly 12 because non-planar surfaces significantly increase the difficulty of forming submicron features. For example, it is difficult to accurately focus photo-patterns to within tolerances of 0.1 micron on nonplanar surfaces because submicron photolithographic equipment generally has a very limited depth of field. Thus, CMP processes often transform a topographical surface into a highly uniform, planar surface.

In the competitive semiconductor industry, it is also desirable to have a high yield of operable devices after CMP processing, yet maximize throughput by producing a planar surface on a workpiece 12 as quickly as possible. CMP processes should thus quickly remove material from the substrate assembly 12 to form a uniformly planar surface at a desired endpoint. For example, when a conductive layer on the substrate assembly 12 is under-planarized in the formation of contacts or interconnects, many of these components may not be electrically isolated from one another because undesirable portions of the conductive layer may remain on the substrate assembly 12. Additionally, when a substrate assembly 12 is over-planarized, components below the desired endpoint may be damaged or completely destroyed. Accurately stopping CMP processing at a desired endpoint helps maintain high yield, high throughput operation because the workpiece may need to be re-polished if it is "under-planarized," or components on the workpiece may be destroyed if the workpiece is "over-polished."

In one conventional method for determining the endpoint of CMP processing, the planarizing period of a particular substrate is fixed using an estimated polishing rate based upon the polishing rate of identical substrates that were planarized under the same conditions. The estimated planarizing period for a particular substrate, however, may not be accurate because the polishing rate or other variables may change from one substrate to another, from one lot of consumables to another, or even from one day to another. Thus, this method may not produce accurate results.

One variable affecting the polishing rate and uniformity of microelectronic workpieces is the condition of the planarizing pad 40. Hence, one aspect of CMP processing is establishing and maintaining the condition (both uniformity and roughness) of the planarizing surface 42 on the planarizing pad 40. Most planarizing pads 40 are initially received from the manufacturer with a hydrophobic, non-planar surface. Before the planarizing pad 40 is used to planarize a microelectronic workpiece 12, the pad 40 is initially conditioned or "broken in." The parameters of the break-in process are typically derived from extensive trial and error. Any changes in these empirically-derived parameters from one pad to the next can adversely impact subsequent planarization processes.

The condition of the planarizing surface 42 also changes over time because residual matter collects on the planarizing surface 42 of the planarizing pad 40. The residual matter, for example, can be from the workpiece 12, the planarizing solution 44 and/or the planarizing pad 40. In certain applications, residual matter from the workpiece 12 can even glaze over sections of the planarizing surface 42 (e.g., planarizing doped silicon dioxide layers). The workpieces 12 can also wear depressions into the planarizing surface 42 that create a non-planar planarizing surface. In many CMP applications, therefore, planarizing pads 40 are accordingly "conditioned" periodically to bring the planarizing surface 42 into a desired condition for planarizing the workpieces 12.

Planarizing pads 40 may be conditioned using a "conditioning stone" or "conditioning pad." In some operations, the planarizing pad 40 is removed from the platen 20 and placed on a separate conditioning machine (not shown). The planarizing machine 10 of FIG. 1, however, includes a conditioning system 50 that rubs an abrasive conditioning stone 60 against the planarizing surface 42 of the planarizing pad 40 between planarizing cycles. The conditioning stone 60 typically includes a second carrier head 62, a bonding layer 64 of nickel or the like covering the bottom surface of the second carrier head 62, and a plurality of diamond particles embedded in a conditioning surface 66 of the bonding layer 64.

The second carrier head 62 is part of a second carrier assembly 70 that sweeps the conditioning stone 60 over the planarizing pad 40 and presses the conditioning surface 66 against the planarizing surface 42. The second carrier assembly 70 of FIG. 1 includes an actuator assembly 74 coupled to the carrier head 62 and to an arm 72. The actuator assembly 74 can rotate the carrier head 62 (indicated by arrow G) and/or move the carrier head 62 axially (indicated by arrow F) to selectively engage the conditioning surface 66 with the planarizing surface 42 and control the force with which the conditioning surface 66 acts against the planarizing surface 42. The second carrier assembly 70 may also include a sweep actuator 76 which rotates the arm 72 (indicated by arrow H) to reciprocate the second carrier head 62 along an arcuate path across the planarizing surface 42.

One problem with conventional conditioning stones 60 is that they wear out over time. Most conventional conditioning systems 50 rub the conditioning stone 60 against the planarizing pad 40 for a fixed period of time. As the conditioning stone 60 degrades, it will remove less of the planarizing pad 40. This leads to variations in the condition of the planarizing pad 40, which can adversely impact quality control of workpieces 12 planarized with the polishing pad 40. At some point, the conditioning stone will no longer remove enough of the planarizing pad 40 in the fixed period of time to appropriately recondition the planarizing surface 42 to the desired uniformity and roughness. Such a conditioning stone 60 is commonly deemed to have reached the end of its useful life and is replaced with a new conditioning stone before conditioning the planarizing pad 40 again. With appropriate changes in the conditioning process parameters, the same conditioning stone 60 can be used in additional conditioning cycles. Commercial microelectronic component manufacturers, however, do not have at their ready disposal processes for accurately detecting the condition of the conditioning stone 60 and the removal rate of the pad material in situ. The current approach, therefore, is wasteful in that conditioning stones 60 are sometimes discarded before the end of their useful life.

The actuator assembly 74 of the second carrier assembly 70 typically urges the conditioning surface 66 of the stone 60 against the planarizing surface 42 of the planarizing pad 40 with a relatively constant force as the conditioning stone 60 sweeps across the planarizing pad 40. The linear velocity of the conditioning stone 60 with respect to the planarizing pad 40 increases as the conditioning stone 60 moves outwardly from the center of the planarizing pad 40 toward the edge of the planarizing pad 40. This can lead to uneven removal of material from the pad 40, causing the pad 40 to deviate from the ideal planar surface. In many systems, the conditioning stone is moved or "swept" across the surface of the planarizing pad 40 as the planarizing pad 40 and/or the conditioning stone 60 are rotated. To obtain a uniform planarizing pad profile, the rate at which the stone 60 sweeps across the pad 40 may be non-uniform. Establishing a suitable sweep profile for a specific combination of materials in the pad 40, stone 60, and consumables often requires substantial trial and error, which can be unduly expensive and time consuming.

DETAILED DESCRIPTION

A. Overview

Figure 1:
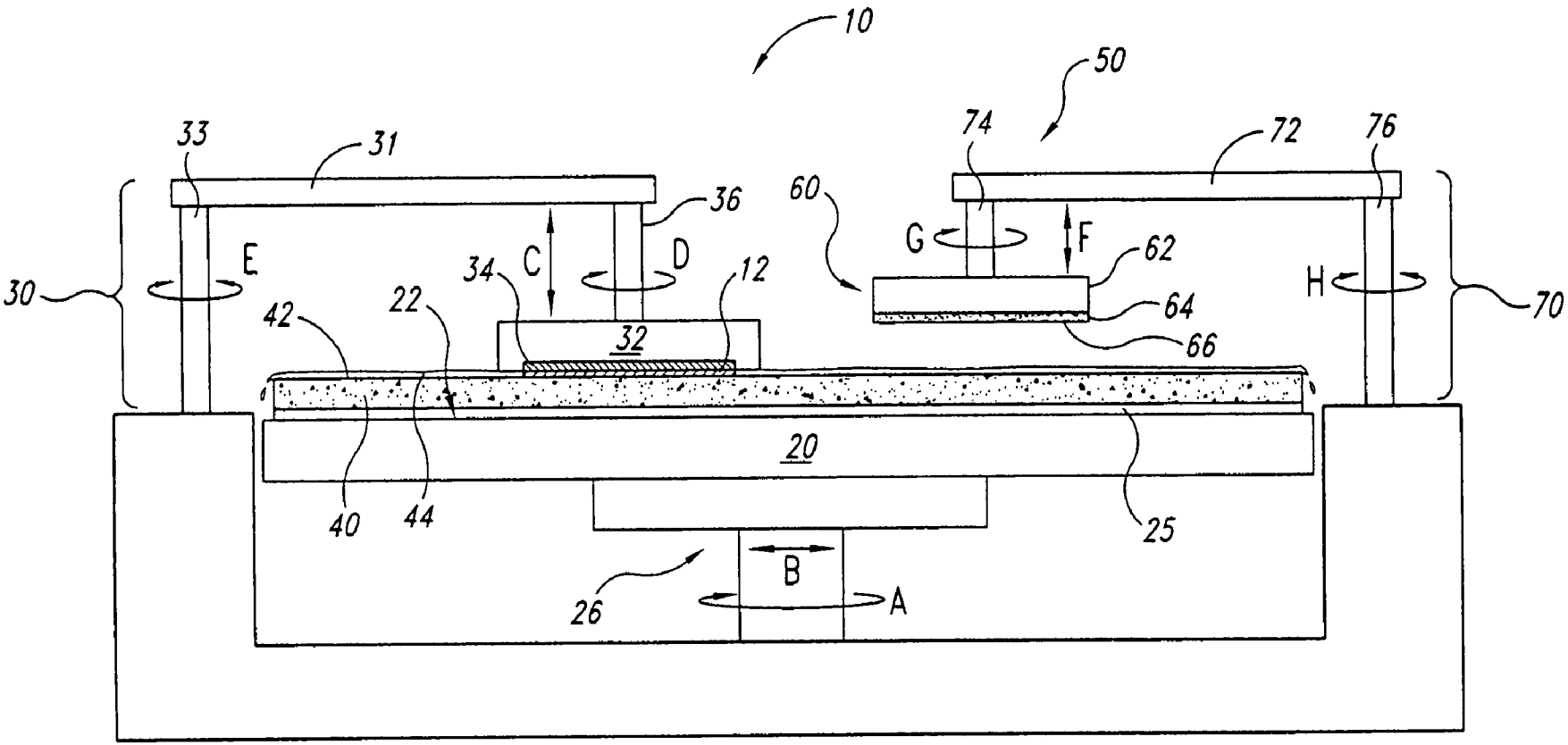
Fig. 1 (Prior Art)
FIG. 1 is a schematic cross-sectional view of a planarizing machine in accordance with the prior art.

Various embodiments of the present invention provide methods and apparatus for processing microelectronic workpieces. The terms "workpiece" and "workpiece assembly" may encompass a variety of articles of manufacture, including, e.g., semiconductor wafers, field emission displays, and other substrate-like structures either before or after forming components, interlevel dielectric layers, and other features and conductive elements of microelectronic devices. The terms "conditioning pad" and "conditioning stone" may encompass any structure suitable for abrading or otherwise conditioning a planarizing pad, including fixed diamond media, for example.

Many specific details of the invention are described below with reference to rotary planarizing machines. The present invention can be practiced using other types of planarizing machines, too. For example, aspects of the invention can be implemented on web-format planarizing machines or on so-called "upside down" CMP machines in which a planarizing pad is carried by the carrier assembly and a microelectronic workpiece is carried by the platen. The following description provides specific details of certain embodiments of the invention illustrated in the drawings to provide a thorough understanding of those embodiments. It should be recognized, however, that the present invention can be reflected in additional embodiments and the invention may be practiced without some of the details in the following description.

In one embodiment, the present invention provides a planarizing system including a workpiece holder, an abrasion member, a driver, and a capacitance gauge. The workpiece holder is adapted to carry a workpiece, e.g., a microelectronic workpiece or a planarizing pad. The abrasion member, which may be a planarizing pad or a conditioning stone, for example, is adapted to position an abrasion surface proximate the workpiece. The driver is adapted to abrasively rub the workpiece against an abrasive medium that comprises the abrasion surface. The capacitance gauge is adapted to measure a proximity signal which varies with proximity of the workpiece holder to the abrasion member. If so desired, the capacitance gauge may include one or more elements carried by the workpiece holder and one or more elements carried by the abrasion member.

Another embodiment provides a conditioning system that is adapted to condition a planarizing pad for planarizing a microelectronic workpiece. The conditioning system includes a platen adapted to carry a planarizing pad and a first capacitance element carried by the platen. A carrier is adapted to carry a conditioning surface in contact with a planarizing pad carried by the platen. A second capacitance element is carried by the carrier. A voltage monitor is adapted to monitor a change in electrical potential between the first and second capacitance elements.

A planarizing system in accordance with another embodiment of the invention includes a platen which carries a planarizing pad having a planarizing surface. The platen also caries first and second planarizing sensors, with the first planarizing sensor being associated with a first region of the planarizing pad and the second planarizing sensor being associated with a second region of the planarizing pad. A carrier is adapted to rub a member against the planarizing surface and to carry a carrier sensor. A detector is electrically coupled to the carrier sensor and to each of the planarizing sensors. The detector is adapted to detect an electrical potential between the carrier sensor and each of the planarizing sensors. This planarizing system may also include a processor that is operatively connected to the detector and is adapted to change a process parameter in response to a change in the detected electrical potential.

Another embodiment of the invention provides alternative planarizing system. This planarizing system includes a platen, a planarizing pad, a carrier, and a carrier sensor which may be similar to those mentioned in the preceding paragraph. This planarizing system includes an elongate planarizing sensor carried by the platen and a detector electrically coupled to the carrier sensor and to the elongate planarizing sensor. The detector is adapted to detect an electrical potential between the carrier sensor and the planarizing sensor at two or more points along the length of the planarizing sensor.

A planarizing system in accordance with still another embodiment of the invention includes a platen, a planarizing pad having a planarizing surface, and a planarizing sensor carried by the platen. A carrier is adapted to rub a member against the planarizing surface and carries first and second carrier sensors at laterally spaced-apart locations. A detector is electrically coupled to the planarizing sensor and to each of the carrier sensors. The detector is adapted to detect an electrical potential between the planarizing sensor and each of the carrier sensors.

Another aspect of the invention provides a method of conditioning a planarizing pad of the type used to planarize microelectronic workpieces. In this method, a conditioning stone is positioned against the surface of the planarizing pad. The conditioning stone is rubbed against the planarizing pad to abrade the pad. An operational voltage is monitored; this operational voltage may be associated with a distance between a conditioning sensor associated with the conditioning stone and a planarizing sensor associated with the planarizing pad. A process parameter may be adjusted in response to a change in the operational voltage. If so desired, the thus-planarized planarizing pad may be replaced with a second planarizing pad and the process may be repeated with the second planarizing pad.

A method in accordance with an alternative embodiment calls for positioning a conditioning surface against a surface of a planarizing pad. The conditioning surface is rubbed against the planarizing pad to abrade the pad. A first operational voltage and a second operational voltage are monitored. The first operational voltage is associated with a first distance between a conditioning sensor associated with the conditioning stone and a first planarizing sensor associated with the planarizing pad. The second operational voltage is associated with a second distance between the conditioning sensor and a second planarizing sensor associated with the planarizing pad. A process parameter may be adjusted in response to a change in the first operational voltage or a change in the second operational voltage.

For ease of understanding, the following discussion is broken down into two areas of emphasis. The first section discusses apparatus of several embodiments of the invention. The second section outlines methods in accordance with other embodiments of the invention.

B. Conditioning and Planarizing Machines

Figure 2:
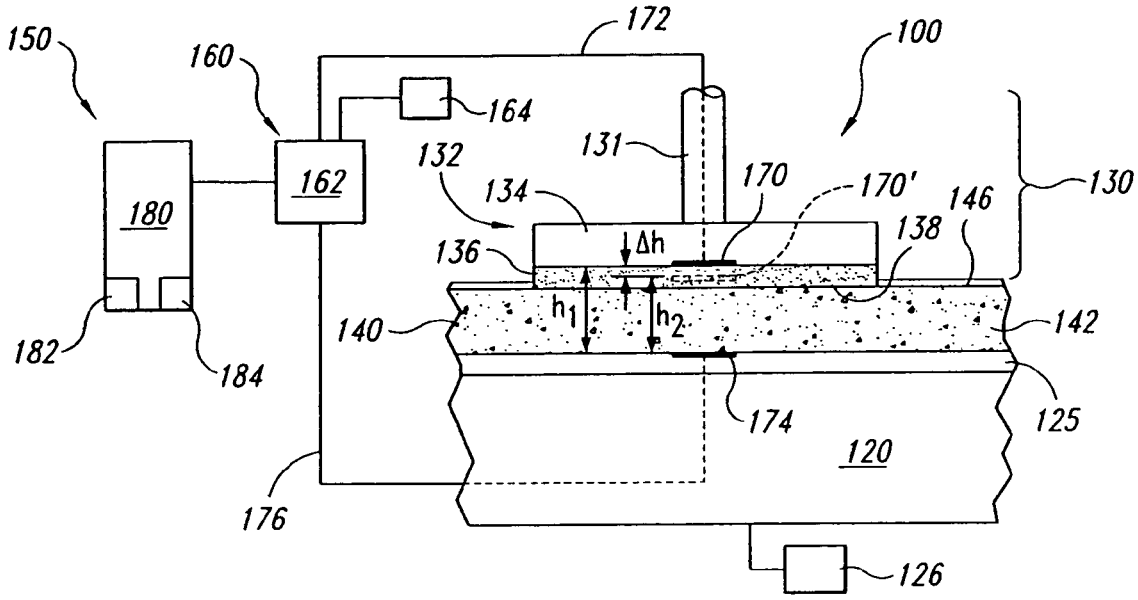
FIG. 2 is a schematic cross-sectional view of part of a planarizing machine having a control system in accordance with an embodiment of the invention.
Figure 3:
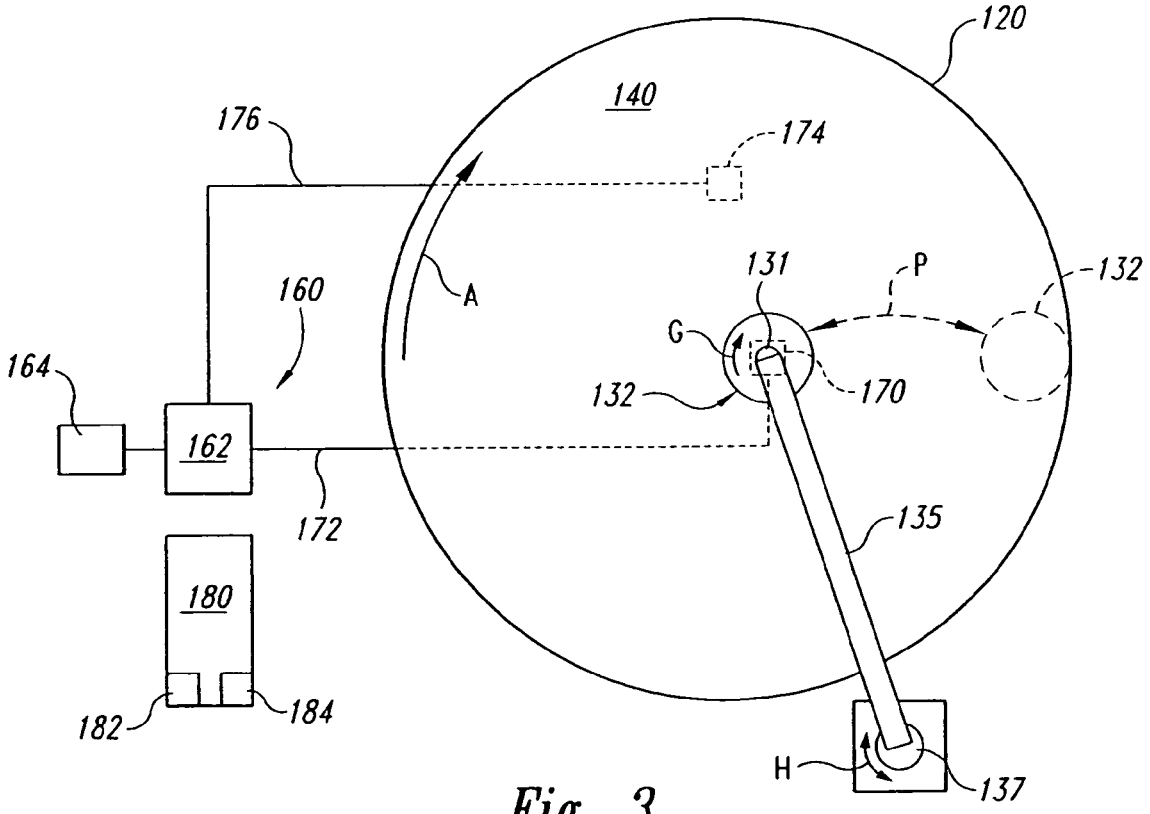
FIG. 3 is a schematic top elevation view of the same planarizing machine shown in FIG. 2.

FIG. 2 is a cross-sectional view of a portion of a conditioning unit or machine 100 in accordance with one embodiment of the invention; FIG. 3 is a schematic top elevation view of the conditioning machine 100. Several features of the conditioning machine 100 are shown schematically. The conditioning machine 100 of this embodiment includes a table or platen 120 coupled to a drive mechanism 126 (shown schematically) that rotates the platen 120. The conditioning machine 100 can also include a carrier assembly 130 having a conditioning stone 132 coupled to a drive mechanism 131. The conditioning stone 132 typically includes a carrier head 134, a bonding layer 136 of nickel or the like covering the bottom surface of the carrier head 134, and diamond particles embedded in a conditioning surface 138 of the bonding layer 136. In one embodiment, the bonding layer 136 comprises an electrically insulative polymeric material, e.g., a cured resin, which increases capacitance measured by the capacitance gage (discussed below). As shown in FIG. 3, the drive mechanism 131 may be linked to a sweep actuator 137 by an elongated arm 135. The drive mechanism 131 may rotate the conditioning stone 132, as indicated by the arrow G. The sweep actuator 137 may reciprocate the conditioning stone 132 along an arcuate sweep path P across the planarizing pad 140.

A planarizing pad 140 having a planarizing body 142 may be attached to the platen 120 by an under-pad 125. The planarizing body 142 can be formed of an abrasive or non-abrasive material having a planarizing surface 146. For example, an abrasive planarizing body 142 can have a resin matrix (e.g., a polyurethane resin) and abrasive particles fixedly attached to the resin matrix. Suitable abrasive planarizing bodies 142 are disclosed in U.S. Pat. Nos. 5,645,471, 5,879,222, 5,624,303, 6,039,633, and 6,139,402, each of which is incorporated herein in its entirety by reference.

The planarizing machine 100 also includes a control system 150 having a capacitance system 160 and a computer 180. The capacitance system 160 includes a capacitance gauge 162 which is coupled to a carrier sensor 170 carried by the conditioning stone 132 and a pad sensor 174 carried by the platen 120. A voltage source 164 may be operatively connected to the capacitance gauge 162 to provide a controlled electrical potential source, facilitating measurement of capacitance between the carrier sensor 170 and the pad sensor 174. The capacitance gauge 162 may be of a conventional design. For example, the capacitance gauge may include a Wheatstone bridge. Any other conventional circuitry which is sufficiently sensitive to measure the anticipated change in capacitance between the sensors 172 and 174 could be used, instead.

In the illustrated embodiment, the carrier sensor 170 is illustrated as a physically distinct element of the conditioning stone 132. It should be understood, though, that this is a schematic illustration and the carrier sensor 170 may be incorporated in another element of the conditioning stone 132. For example, if the bonding layer 136 is conductive, e.g., if it is formed of nickel, the carrier sensor may comprise the bonding layer 136 or a physically indistinct portion of the bonding layer 136.

The carrier sensor 170 may be coupled to the capacitance gauge 162 by a carrier sensor line 172 and the pad sensor 174 may be connected to the capacitance gauge 162 by a pad sensor line 176. In one embodiment, the carrier 170 and the pad sensor 174 each comprise an electrically conductive foil, such as a thin sheet of copper or the like. In another embodiment, one or both of the sensors 170, 174, may include electronic circuitry. For example, one of the sensors 170, 174 may include a Wheatstone bridge or other capacitance measuring circuitry, effectively combining the capacitance gauge 162 with one of the sensors 170, 174 instead of including the gauge 162 as a separate element.

The capacitance gauge 162 is adapted to generate an output signal which is correlated to a distance between a reference point associated with the conditioning stone 132 and a reference point associated with the planarizing pad 140. In the illustrated embodiment, the capacitance gauge 162 is adapted to generate an output signal which is correlated to a distance between the carrier sensor 170, which is carried by the carrier head 134 of the conditioning stone 132, and the pad sensor 174, which is carried by the under-pad 125 of the platen 120. The carrier sensor 170 is carried in electrical contact with the bonding layer 136 of the conditioning stone. The pad sensor 174 is carried in electrical contact with a back surface of the planarizing pad 140.

When the conditioning surface 138 of the conditioning stone 132 is first brought into contact with the planarizing surface 146 of the planarizing pad 140, the carrier sensor 170 will be spaced from the pad sensor 174 by an initial height $h_1$. As the conditioning stone 132 rubs against the planarizing pad 140, though, the thickness of the planarizing pad 140 will be reduced. As a consequence, the carrier sensor 170 will move toward the pad sensor 174. As shown schematically in FIG. 2, at some point during the planarizing process, the carrier sensor 170 will move to a second position, indicated as 170', which is spaced a height $h_2$ from the pad sensor 174. The distance $h_2$ is less than the distance $h_1$. The relative displacement $\Delta h$ of the sensors 170, 174 is proportional to, and may directly correspond to, the change in thickness of the planarizing body 142 of the planarizing pad 140. As this relative displacement $\Delta h$ increases, the capacitance of the material between the two sensors 170, 174 will decrease. This will alter the output signal from the capacitance gauge 162 as a reflection of the change in proximity of the two sensors 170, 174.

In one embodiment, the output signal of the capacitance gauge 162 comprises a measured voltage between the carrier sensor 170 and the pad sensor 174. As the conditioning stone 132 reduces the thickness of the planarizing pad 140, the capacitance between these sensors 170 and 174 will decrease, causing a corresponding decrease in measured voltage.

The capacitance system 160 is operatively associated with the computer 180 and the computer 180 may monitor an output signal from the capacitance gauge 162. In one embodiment, the computer 180 has a database 182 containing a plurality of reference capacitance measurements corresponding to the proximity of the sensors 170 and 174. The computer 180 also contains a programmable processor 184. In one embodiment, the processor 184 causes the control system 150 to control a processing parameter of the conditioning machine 100 when the measured capacitance signal is approximately the same as a reference capacitance signal stored in the database 182. The computer 180, therefore, can indicate that the conditioning cycle is at an endpoint, the planarizing pad has become planar and is suitably reconditioned, the rate of removal of the planarizing body 142 has changed, the downforce of the conditioning stone 132 against the planarizing pad. 140 is outside acceptable limits, and/or control another aspect of the conditioning cycle.

When the conditioning stone 132 is first brought into contact with the planarizing pad 140 and the sensors 170 and 174 are spaced a distance $h_1$ from one another, the capacitance gauge 162 will output an initial reference signal, which may be an initial reference voltage. As the conditioning cycle progresses and the sensors 170 and 174 move toward one another, the capacitance gauge 162 will continue to output a capacitance signal. The computer processor 184 may compare this operational signal to the initial reference signal during the course of the conditioning cycle. This enables the computer 180 to determine the displacement $\Delta h$ of the sensors 170 and 174 during the conditioning cycle.

The database 182 may contain a series of reference capacitance changes which may be empirically determined for the combination of the specific type of conditioning stone 132 and planarizing pad 140 employed in the conditioning machine 100. When the difference between the initial reference signal and the monitored operational signal from the capacitance gauge 162 reaches a particular value corresponding to a known differential in the database 182, the computer 100 may determine the desired thickness of the planarizing pad 140 has been removed and the control system 150 can terminate rubbing of the conditioning stone 132 against the planarizing pad 140.

If the conditioning stone 132 remains stationary with respect to the platen 120, the change in thickness of the planarizing pad 140 may be the only factor affecting the distance between the sensors 170 and 174. As illustrated in FIG. 3, though, the conditioning stone 132 may follow a sweep path P across the surface of the planarizing pad 140. Even if the pad sensor 174 remains stationary as the platen 120 rotates (arrow A), the distance between the carrier sensor 170 and the pad sensor 174 will change as the conditioning stone 132 oscillates along the sweep path P. In the illustrated embodiment, the pad sensor 174 is displaced from the center of rotation of the platen 120. This adds a further degree of complexity to the signal output by the capacitance gauge 162.

The control system 150 may also control or at least monitor operation of the sweep actuator 137. The position of the conditioning stone 132 with respect to the platen 120, therefore, may be known at all times. The computer 180 may factor in the position of the conditioning stone with respect to the platen 120 when comparing the signal from the capacitance gauge 162 to the reference signals in the database 182. In one embodiment, the computer will determine when the conditioning stone 132 is in a desired position relative to the pad sensor 174. When the conditioning stone 132 and pad sensor 174 are appropriately aligned, the computer 180 may compare the output signal from the capacitance gauge 162 to the database 182. Since the conditioning process routinely takes a long period of time relative to the rotation of the platen 120, such an intermittent determination of the relatively displacement $\Delta h$ should suffice to appropriately control the conditioning process.

In the conditioning machine 100 of FIGS. 2 and 3, the conditioning stone 132 carries a single carrier sensor 170 and the platen 120 carries a single pad sensor 174. This permits a gross determination of the change in thickness of the planarizing pad 140. However, this arrangement may not give enough information to ensure that the planarizing surface 146 of the planarizing body 142 has the desired degree of planarity.

Figure 4:
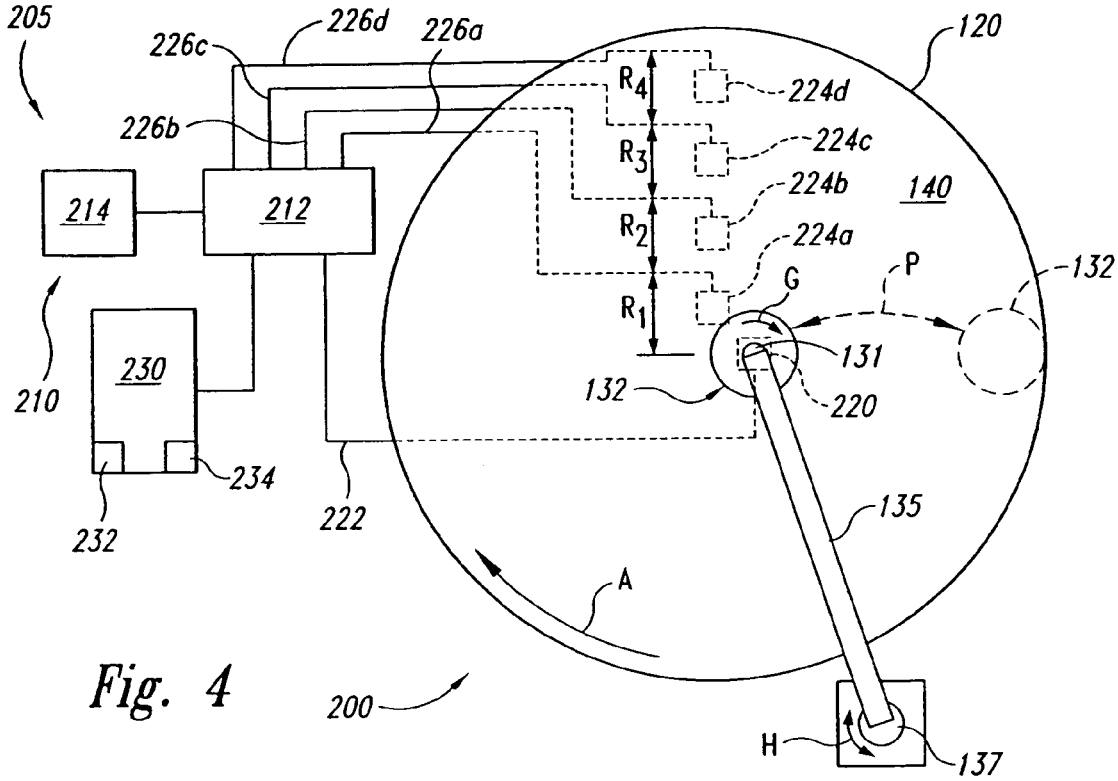
FIG. 4 is a schematic top elevation view, similar to FIG. 3, of a planarizing machine in accordance with another embodiment of the invention.

The conditioning machine 200 of FIG. 4 is similar to the conditioning machine 100 of FIGS. 2 and 3. In particular, the conditioning machine 200 may include a platen 120, carrier assembly 130, and planarizing pad 140 substantially the same as those employed in FIGS. 2 and 3. Accordingly, like reference numbers have been used to indicate like components in the two conditioning machines 100 and 200.

One of the differences between the conditioning machine 100 of FIGS. 2-3 and the conditioning machine 200 of FIG. 4 is the number of sensors employed. The conditioning machine 100 has a single carrier sensor 170 and a single pad sensor 174. In contrast, the conditioning machine 200 has a single carrier sensor 220 and a plurality of pad sensors 224*a-d*. The carrier sensor 220 is coupled to the capacitance gauge 212 by a carrier sensor line 222 and each of the pad sensors 224*a-d* is coupled to the capacitance gauge 212 by a separate pad sensor line 226*a-d*, respectively. The capacitance gauge 212 may be operatively connected to a voltage source 214 and a computer 230. The computer 230 may have a database 232 and a programmable processor 234 analogous to the database 182 and processor 184 of the computer 180, discussed above.

Each of the pad sensors 224 is associated with a region of the planarizing pad 140. In particular, a first pad sensor 224*a* is associated with a first region $R_1$ of the planarizing pad 140, a second pad sensor 224*b* is associated with a second region $R_2$, a third pad sensor 224*c* is associated with a third region $R_3$, and a fourth pad sensor 224*d* is associated with a fourth region $R_4$. In the embodiment shown in FIG. 4, the pad sensors 224 are spaced equidistantly along a radius of the planarizing pad 140. Each of the planarizing pad regions $R_{1-4}$, therefore, spans about the same distance along the radius of the planarizing pad 140.

As the planarizing pad 140 rotates (indicated by arrow A), each of the regions R will cross the sweep path P of the conditioning stone. Consequently, the carrier sensor 220 will be in closest proximity to the first pad sensor 224*a* when the carrier sensor 220 is positioned in the first region $R_1$; the carrier sensor 220 will be in closest proximity to the second pad sensor 224*b* when positioned in the second region $R_2$; etc.

Each of the pad sensors 224*a-d* is separately connected to the capacitance gauge 212. The capacitance gauge 212 may be adapted to identify a separate voltage between the carrier sensor 220 and each of the pad sensors 224. Hence, the output signal from the capacitance gauge 212 may include a first voltage correlated to the distance between the carrier sensor 220 and the first pad sensor 224*a*, a second voltage correlated to a distance between the carrier sensor 220 and the second pad sensor 224*b*, a third voltage correlated to a distance between the carrier sensor 220 and the third pad sensor 224*c*, and a fourth voltage correlated to a distance between the carrier sensor 220 and the fourth pad sensor 224*d*. The capacitance gauge 212 will communicate these separate voltage measurements to the computer 230.

This series of voltages enables the computer 230 to define a thickness profile of the planarizing pad 140. If the planarizing pad 140 profile is not planar at the outset of the conditioning process, a different reference voltage may be associated with each of the regions $R_{1-4}$ of the planarizing pad 140. The control system 205 of the conditioning machine 200 may then control process parameters of the conditioning cycle to remove more of the planarizing pad in some of the regions than in other regions to make the planarizing pad more planar. For example, if the first region $R_1$ is higher than the other regions $R_{2-4}$ the sweep actuator 137 may be controlled to increase the abrasion time of the conditioning stone 132 in the first region $R_1$ as compared to the other regions $R_{2-4}$. Either in addition to or instead of adjusting the abrasion time along the sweep path P, other process parameters may be adjusted, including the rotational speed of the conditioning stone 132, the rotational speed of the platen 120, and/or the downforce of the conditioning stone 132 against the planarizing pad 140. By controlling these process parameters on a region-by-region basis, the planarizing surface of the planarizing pad 140 may be profiled more accurately.

In the embodiment of FIG. 4, four pad sensors 224*a-d* are shown. It should be understood, though, that fewer or more pad sensors 224 might be employed. The pad sensors 224 in FIG. 4 are also illustrated as falling along a single radial line. In other embodiments, the pad sensors 224 may be arranged differently. For example, the pad sensors 224 may be aligned across the entire width of the planarizing pad 140 along a diameter of the pad 140.

Figure 5:
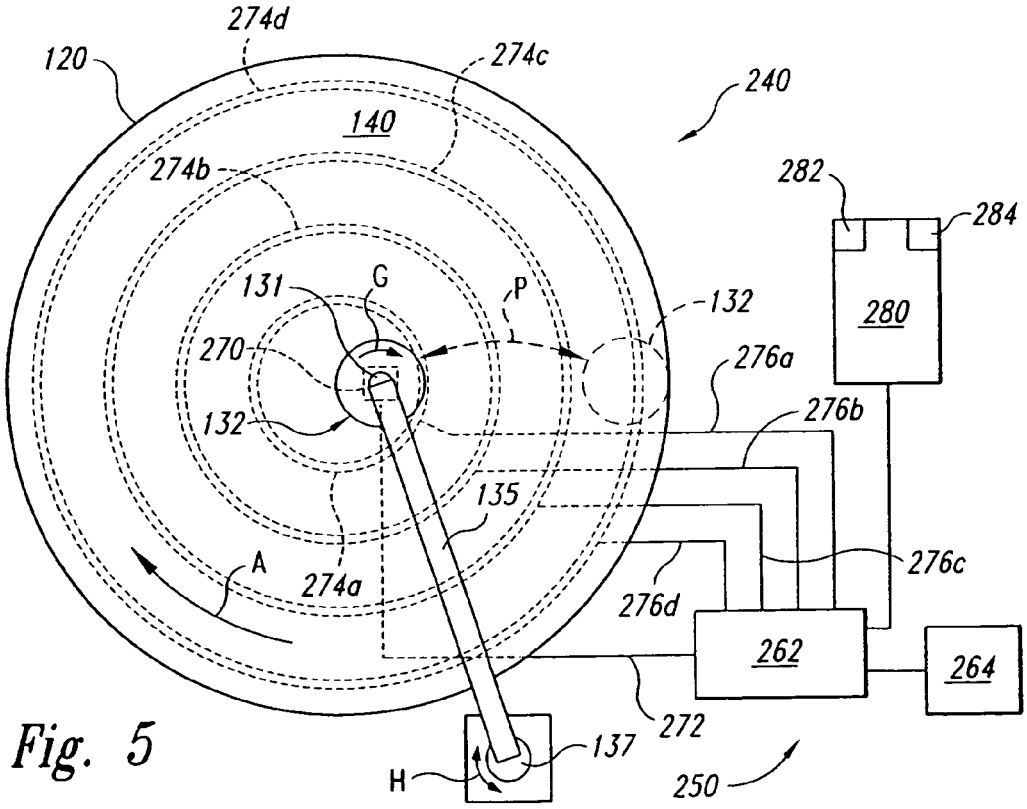
FIG. 5 is a schematic top elevation view, similar to FIG. 3, in accordance with an alternative embodiment of the invention.

FIG. 5 schematically illustrates another multi-sensor conditioning machine 240 in accordance with a different embodiment of the invention. This conditioning machine 240 may employ a platen, carrier assembly, and planarizing pad similar to those employed in FIGS. 2-3; like reference numbers are used to indicate like elements in the conditioning machines 100 and 240.

The conditioning machine 240 of FIG. 5 includes a single carrier sensor 270 coupled to a capacitance gauge 262 by a carrier sensor line 272. A plurality of annular pad sensors 274*a-d* are associated with the planarizing pad 140. Each of these pad sensors 274*a-d* communicates with the capacitance gauge 262 by a separate pad sensor line 276*a-d*, respectively. The capacitance gauge 262 may be operatively connected to a voltage source 264 and a computer 280. The computer 280 may include a database 282 and a programmable processor 284 similar to the computer 180 of FIGS. 2 and 3 and its associated database 182 and processor 184.

Operation of the conditioning machine 240 of FIG. 5 may be analogous to the operation of the conditioning machine 200 of FIG. 4. Each of the annually pad sensors 274*a-d* is associated with a separate circular or angular region of the planarizing pad 140. As the conditioning stone 132 oscillates between the middle of the planarizing pad 140 and the outer edge of the planarizing pad 140 along the sweep path P, the carrier sensor 270 will come into more immediate proximity with each of the angular pad sensors 274. The capacitance gauge 262 may output a separate voltage signal associated with each of the pad sensors 274, enabling the computer 280 to define a pad profile.

In the conditioning machine 200 of FIG. 4, the pad sensors 224*a-d* permit the computer 230 to determine a profile of the planarizing pad 140 as a series of measurements. Each of these measurements is taken at a point associated with a fairly localized pad sensor 224. If the pad sensors 224*a-d* are aligned along a radius of the planarizing pad 140, as shown, the pad profile may reflect a thickness profile along a single radial line. The annular pad sensors 274 of the conditioning machine 240 of FIG. 5 facilitates a more detailed pad profile. As the planarizing pad 140 rotates with respect to the conditioning stone 132, the distance between the carrier sensor 270 and the nearest pad sensor 274 will essentially covary with the thickness of the planarizing pad 140 at different positions along the circular length of the pad sensor 274. As a consequence, the computer 280 of FIG. 5 can determine a thickness profile of the planarizing pad 140 which is more reflective of the entire planarizing surface 146 rather than a profile along a single radial line.

Figure 6:
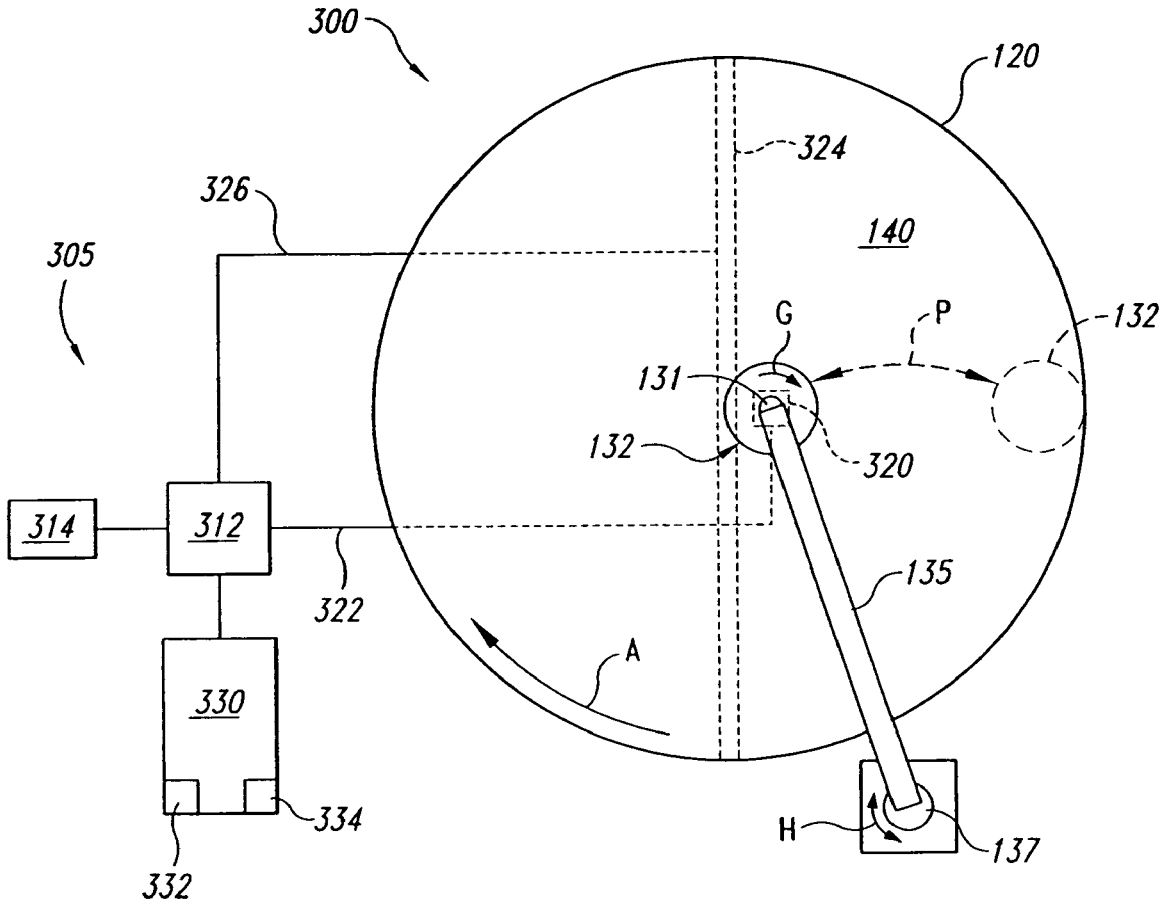
FIG. 6 is a schematic top elevation view, similar to FIG. 3, of a planarizing machine in accordance with still another embodiment of the invention.

FIG. 6 schematically illustrates a conditioning machine 300 in accordance with still another embodiment of the invention. Again, many of the elements of the conditioning machine 300 are similar to elements of the conditioning machine 100 of FIGS. 2 and 3 and like reference numbers are used in all three Figures to illustrate like elements.

The conditioning machine 100 of FIGS. 2-3 and the conditioning machine 300 of FIG. 6 both include a single carrier sensor 320 and a single pad sensor 324. The carrier sensor 320 is coupled to a capacitance gauge 312 by a carrier sensor line 322 and the pad sensor 324 is coupled to the capacitance gauge 312 by a pad sensor line 326. The capacitance gauge 312 is operatively connected to a voltage source 314 and a computer 330. The computer 330 includes a database 332 and a programmable processor 334, which may be analogous to the computer 180 of the conditioning machine 100 and its associated database 182 and processor 184.

The pad sensor 174 of the conditioning machine 100 comprises a relatively localized sensor. The pad sensor 324 of the conditioning machine 300, in contrast, is elongated and covers more of the area of the pad 140. The particular pad sensor 324 shown in FIG. 6 extends diametrically from one side of the planarizing pad 140 to the opposite side of the planarizing pad 140. The pad sensor 324 may, for example, take the form of an elongate strip of copper foil or the like.

As the platen 120 turns (as indicated by arrow A) and the conditioning stone 132 oscillates across the planarizing pad 140 along its sweep path P, the carrier sensor 320 will be positioned above a different point along the length of the pad sensor 324 at different times. The control system 305 of the conditioning machine 300 may communicate with the sweep actuator 137, enabling the control system 305 to identify the location of the carrier sensor 320 along the sweep path P at any given time. This, in combination with knowledge of the angular location of the pad sensor 324 (which may be derived from the cyclical voltage signal output by the capacitance gauge 312) enables the computer 330 to define and track a profile of a planarizing pad 140 during the conditioning cycle. As explained above in connection with FIG. 5, for example, this permits the control system 305 to adjust one or more process parameters of the conditioning cycle at different points along the sweep path P, facilitating greater control over the planarity of the planarizing pad 140.

In each of the embodiments shown in FIGS. 2-6, the pad sensor (e.g., sensor 174 in FIG. 2) is positioned beneath the planarizing pad 140. Because the thickness or proximity measurements are based on capacitance, there is no need for the sensors to be visible. This is in contrast to other line-of-sight systems, such as the interferometer-based system suggested in U.S. Pat. No. 6,075,606 (Doan), the entirety of which is incorporated herein by reference. In some circumstances, space constraints may make it difficult or impractical to utilize a line-of-sight optical system such as that suggested by Doan. Utilizing a capacitance-based approach such as that outlined above in connection with FIGS. 2-6 avoids this difficulty.

It should be understood, though, that the pad sensor need not be covered by planarizing pad or even be direct electrical contact with the planarizing pad. For example, if the planarizing pad 140 in FIG. 2-3 were smaller than the platen 120 underlying the pad 140, a portion of the platen 120 would extend radially outward beyond the periphery of the planarizing pad 140. The sensor 174 could be positioned on the portion of the platen extending beyond the edge of the pad 140, leaving the sensor 174 exposed. While the absolute value and rate of change of the capacitance measured by the capacitance gauge 162 may differ if the sensor 174 is exposed instead of in direct electrical contact with the planarizing pad 140, the principal of operation outlined above may remain substantially the same. As so desired, the carrier sensor 172 could be exposed, such as by extending it radially outwardly beyond the edge of the carrier head 134, either instead of or in addition to exposing the pad sensor 174.

Figure 7:
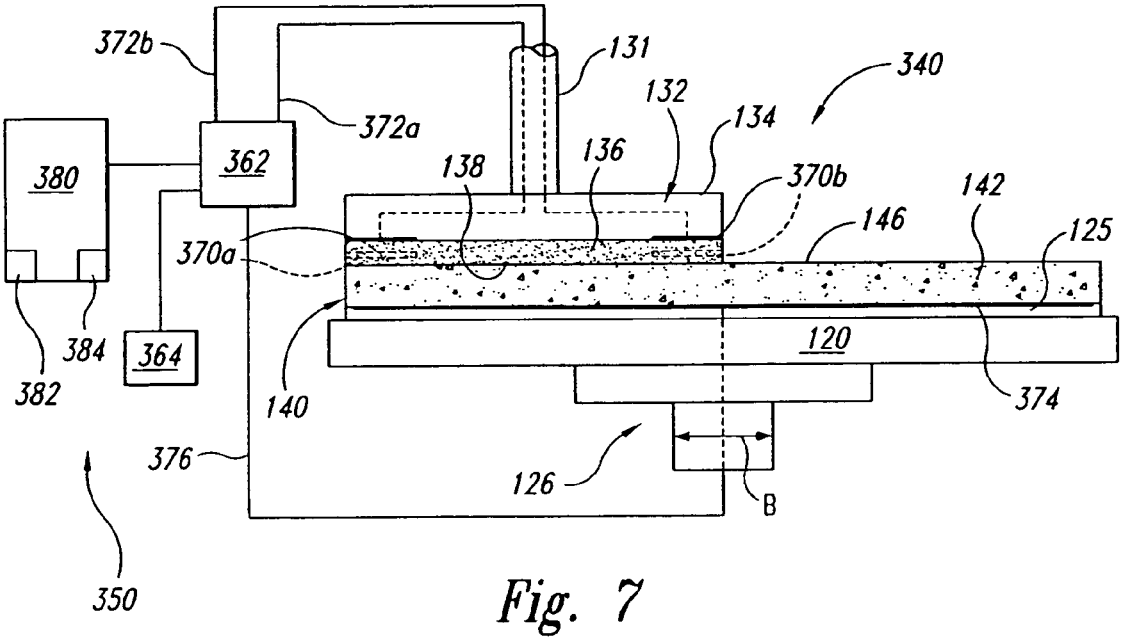
FIG. 7 is a schematic cross-sectional view of a planarizing machine having a control system in accordance with a different embodiment of the invention.
Figure 8:
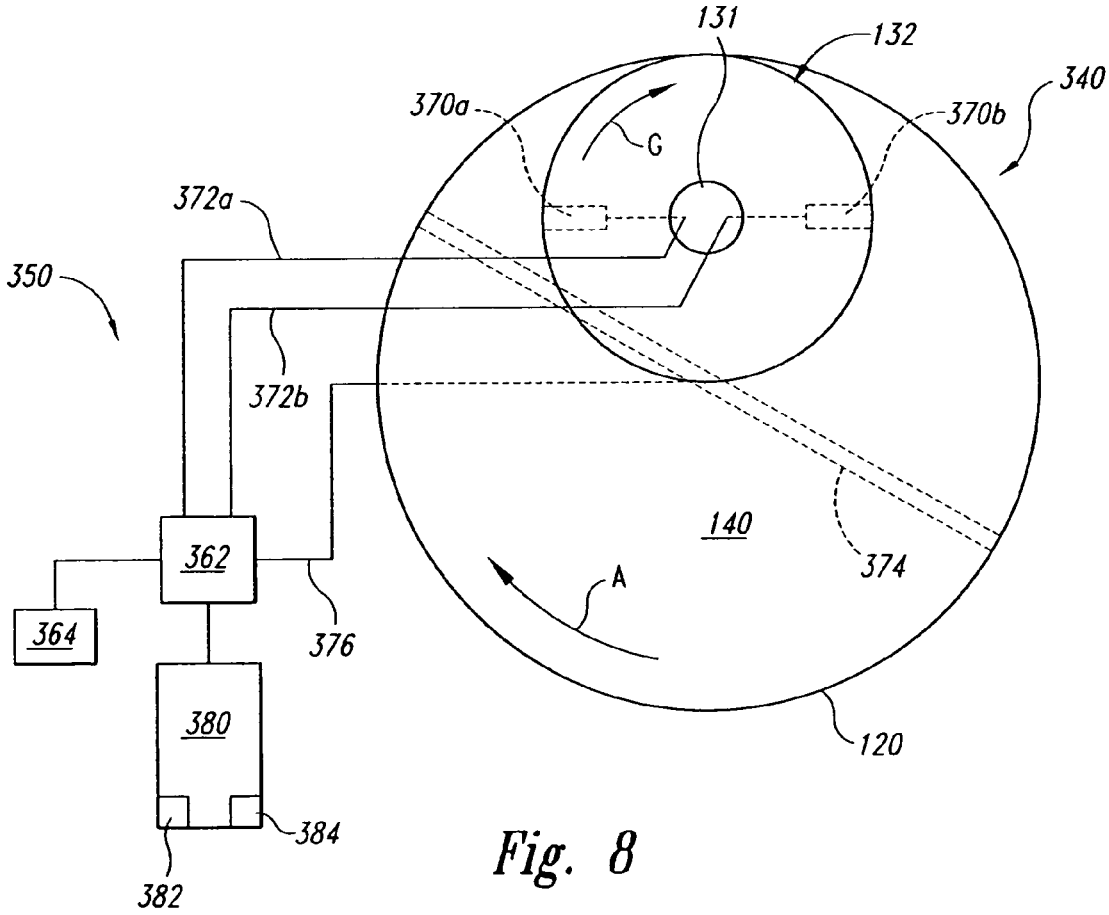
FIG. 8 is a schematic top elevation view of the planarizing machine of FIG. 7.

FIGS. 7 and 8 schematically illustrate a conditioning machine 340 in accordance with an alternative embodiment of the invention. Many of the elements of the conditioning machine 340 are substantially the same as elements of the conditioning machine 100 and like elements bear like reference numbers in FIGS. 2-3 and 7.

In each of the embodiments shown in FIGS. 2-6, the conditioning machine includes a single carrier sensor (e.g., carrier sensor 170) and one or more pad sensors (e.g., pad sensor 174). The conditioning machine 340 of FIGS. 7 and 8, however, includes a single pad sensor 174 and first and second carrier sensors 370*a-b*. The carrier head 134 of the conditioning stone 132 carries the first carrier sensor 370*a* and the second carrier sensor 370*b* in electrical contact with the bonding layer 136. The pad sensor is electrically connected to a capacitance gauge 362 by a pad sensor line 176, a first carrier sensor line 372*a* connects the first carrier sensor 370*a* to the capacitance gauge 362, and a second carrier sensor line 372*b* connects the second carrier sensor 370*b* to the capacitance gauge 362. The capacitance gauge 362 is operatively connected to a voltage source 364 and a computer 380. The computer 380 may include a database 382 and a programmable processor 384 that are analogous to the database 182 and processor 184 of the computer 180 discussed above in connection with FIGS. 2 and 3.

The conditioning machine 340 of FIGS. 7 and 8 may be operated in a manner analogous to those outlined above in connection with the conditioning machine 100 of FIGS. 2 and 3 and the conditioning machine 300 of FIG. 6. The control system 350 may control process parameters of the conditioning machine 340 based on the output signal from the capacitance gauge 362 associated with just one of the carrier sensors 370. The second carrier sensor 370*b*, for example, may serve as a redundant backup and as a basis for detecting or resolving anomalies in the output signal associated with the first carrier sensor 370*a*. In another embodiment, the computer 380 monitors the output signals associated with both of the carrier sensors 370. If the output signal associated with one of the carrier sensors (e.g., 370*a*) differs significantly from the output signal of the other carrier sensor (370*b*), this may indicate an error in operation of the conditioning machine 340, such as that the conditioning surface 138 of the conditioning stone 132 is not level with respect to the platen 120.

Figure 9:
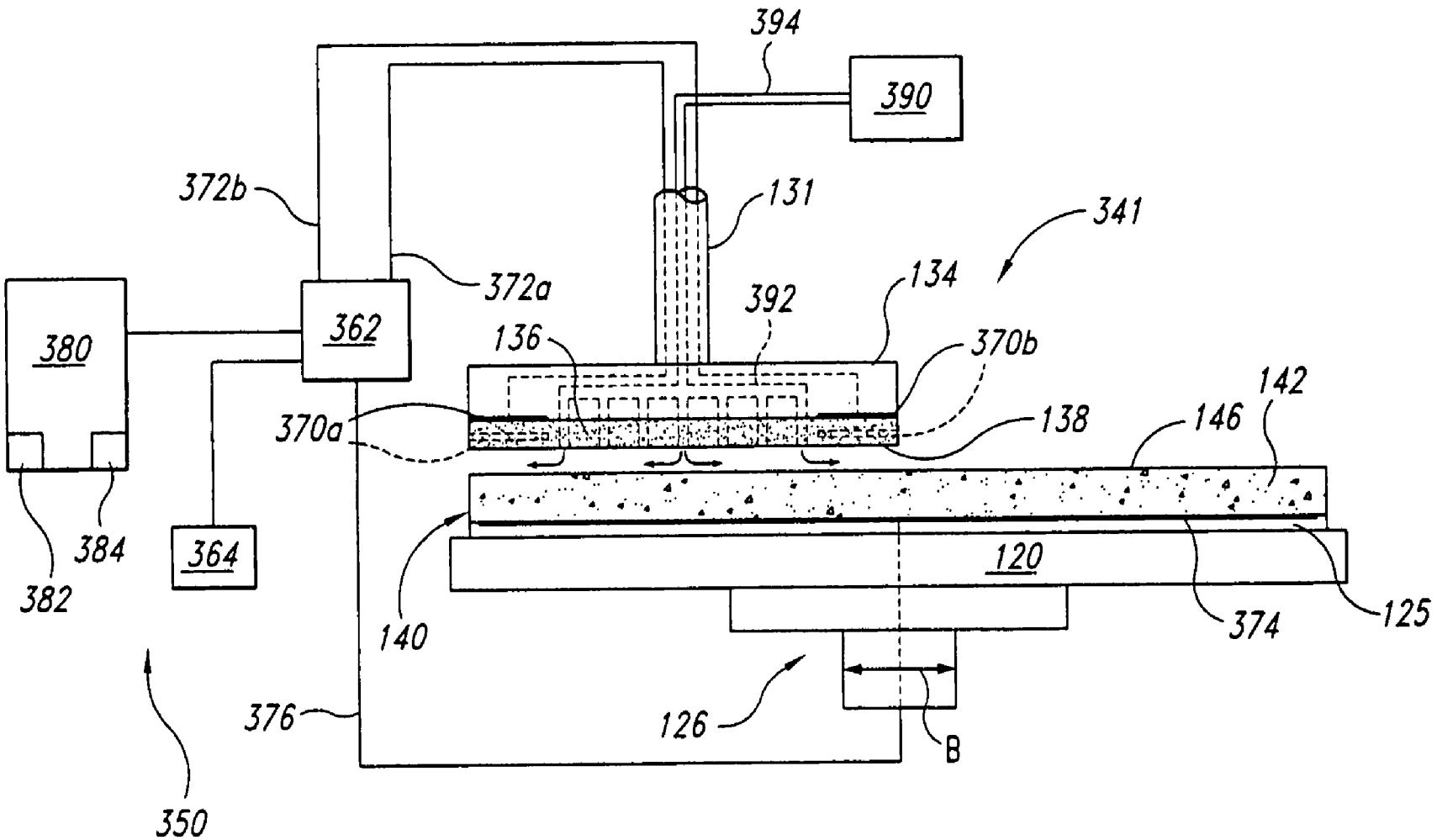
FIG. 9 is a schematic cross-sectional view of a planarizing machine in accordance with still another embodiment of the invention.

FIG. 9 schematically illustrates a conditioning machine 341 in accordance with an alternative embodiment of the invention. Most of the elements of the conditioning machine 341 are substantially the same as elements of the conditioning machine 340 in FIGS. 7 and 8 and bear like reference numbers in FIGS. 7-9.

The primary difference between the conditioning machines 340 and 341 is that the conditioning machine 341 of FIG. 9 includes a gas supply 390 which communicates with a gas plenum 392 via a gas line 394. The gas plenum 392 is carried by the conditioning stone 132 and is adapted to direct a flow of gas from the conditioning surface 138 toward the planarizing pad 140, as suggested by arrows in FIG. 9. The gas supply 392 may simply comprise a compressor to deliver a flow of air through the plenum 392. In another embodiment, the gas supply 392 comprises a supply of a dry, relatively inert gas such as nitrogen. In either embodiment, the gas may be dried by a desiccant or the like prior to being delivered to the plenum 392. As explained below, this gas supply can facilitate measurement of a thickness profile of a relatively dry planarizing pad 140, reducing any impact of variations in the composition, thickness or flow rate of any fluid on the planarizing surface 146.

Each of the embodiments discussed above in connection with FIGS. 2-9 focus on applications of the invention for conditioning a planarizing pad. It should be recognized, however, that aspects of the invention may find utility in planarizing a workpiece, as well.

Figure 10:
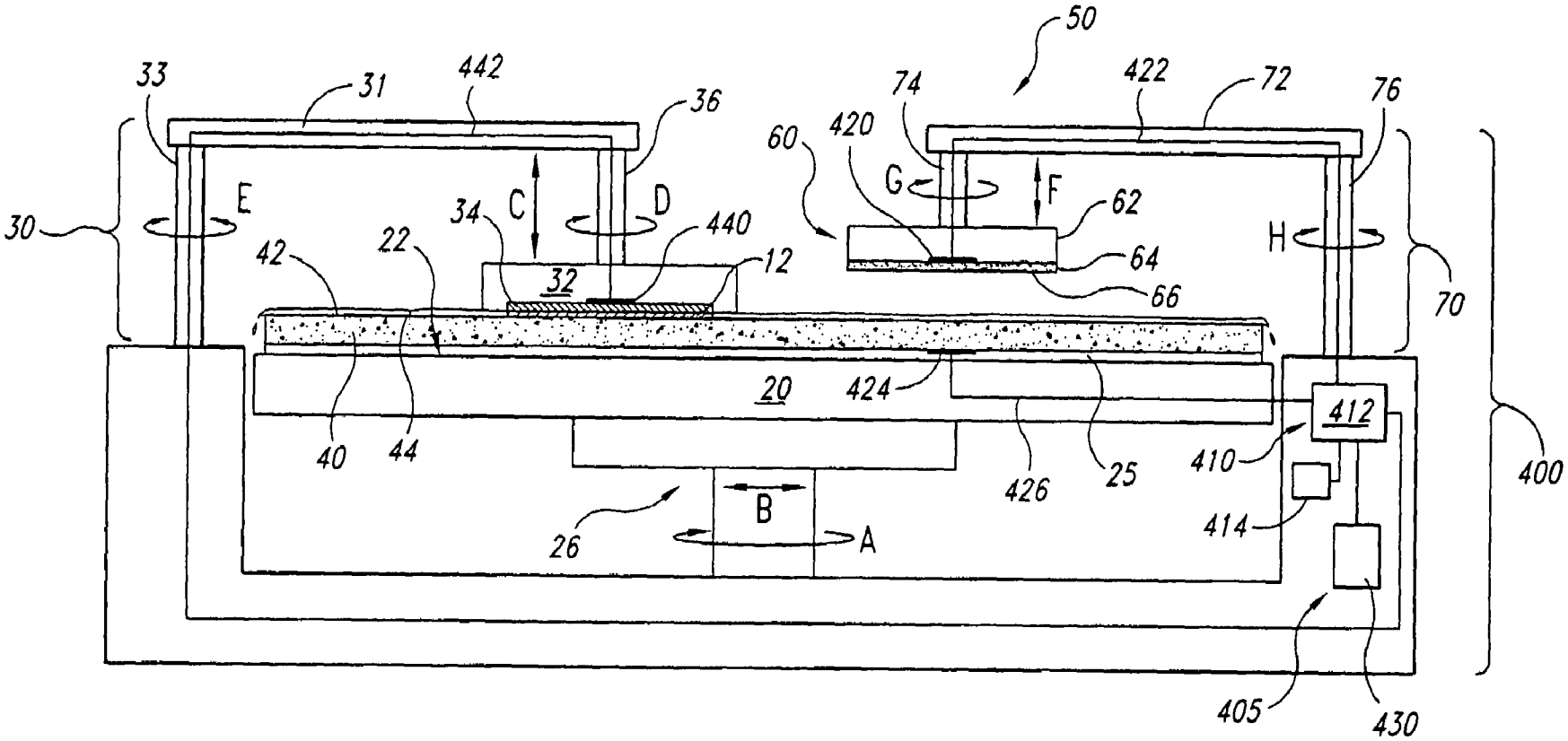
FIG. 10 is a schematic cross-sectional view of a planarization machine in accordance with the present invention.

FIG. 10 schematically illustrates one manner in which aspects of the present invention may be employed in a conventional planarizing machine 10 such as that shown in FIG. 1. The modified planarizing machine 400 of FIG. 10 includes many of the same elements as the planarizing machine 10 shown in FIG. 1. Like reference numbers are used in FIGS. 1 and 10 to indicate shared elements in these two machines 10 and 400.

The planarizing machine 400 of FIG. 10 includes a single pad sensor 424 connected to a capacitance gauge 412 by a pad sensor line 426. The capacitance gauge 412 may be coupled to a voltage source 414 and a computer 430. The computer 430 may be directly analogous to the computer 180 discussed above in connection with FIGS. 2 and 3.

The control system 405 of FIG. 10 also includes a first carrier sensor 440 carried by the substrate holder 32 and a second carrier sensor 420 carried by the carrier head 62 of the conditioning stone 60. The first carrier sensor 440 may be operatively connected to the capacitance gauge 412 by a first carrier sensor line 442 and the second carrier sensor 420 may be operatively connected to the capacitance gauge 412 by a second carrier sensor line 422.

In typical operation, the planarizing pad 40 will be in contact with either a workpiece 12 carried by the substrate holder 32 or with the conditioning stone 60. FIG. 10 illustrates the configuration of the planarizing machine 400 when planarizing a substrate 12. In this configuration, the first carrier sensor 440 is held against and in electrical contact with the back face of the substrate 12. The capacitance gauge 412 may deliver an output signal, e.g., a voltage signal, which is correlated to proximity of the first carrier sensor 440 and the pad sensor 424. In a manner directly analogous to that discussed above in connection with FIGS. 2 and 3, for example, the computer 430 may correlate a change in the signal from the capacitance gauge 412 to a change in the distance between the two sensors 440 and 424 over time. Upon reaching a predetermined change in the voltage measured by the capacitance gauge 412, the control system 405 may indicate that the planarizing process has reached its endpoint and cease rubbing of the workpiece 12 against the planarizing pad 40.

When the planarizing pad 40 needs conditioning, the substrate holder 32 may be moved upwardly away from the planarizing pad 40 and the conditioning stone 60 may be moved downwardly into contact with the planarizing pad 40. The capacitance gauge 412 may then generate an output signal that is correlated to the proximity of the second carrier sensor 420 to the pad sensor 424. As discussed above, this proximity information can be used by the control system 405 to control process parameters of the conditioning cycle.

When planarizing a workpiece 12, the planarizing pad 40 serves as an abrasion member for the workpiece 12. When conditioning the planarizing pad 40, though, the conditioning stone 60 serves as the abrasion member and the planarizing pad 40 takes on the role of a workpiece being planarized by the abrasion member.

C. Methods

As noted previously, some embodiments of the invention provide methods for planarizing a workpiece, e.g., for conditioning a planarizing pad. For ease of understanding, the following discussion makes reference to the conditioning machine 200 of FIG. 4 and its components to illustrate aspects of these methods. It should be understood, though, that the methods outlined below are not limited to being carried out on this conditioning machine 200, but may be performed on any suitable apparatus, including, but not limited to, the conditioning machines 100, 240, 300 and 340 shown in FIGS. 2, 3, and 5-9 or the planarizing machine 400 of FIG. 10. The following discussion also focuses primarily on conditioning a planarizing pad with a conditioning stone. As noted above, however, some embodiments employ aspects of the invention in planarizing a workpiece 12, e.g., in planarizing a microelectronic workpiece such as a semiconductor wafer.

One embodiment provides a method in which the conditioning stone 132 is positioned against the planarizing surface 146 of the planarizing pad 140. The control system 205 may then determine a reference voltage or reference voltages associated with an initial distance between the carrier sensor 220 and one or more of the planarizing sensors 224. In one particular embodiment, the conditioning stone is rotated (arrow G) and moved along its sweep path P. In the first traverse of the sweep path P, the conditioning stone 132 will through the region $R_{1-4}$ of the planarizing pad 140 associated with each pad sensor 224*a-d*, respectively. The output of the capacitance gauge 212 for each pad sensor 224 may be stored as an initial reference signal for that sensor. Once these initial reference signals are recorded, the computer 230 may define an initial pad profile.

As the conditioning stone 132 continue to rub against the planarizing pad 140, the distance between the carrier sensor 220 and each of the pad sensors 224 will change. The control system 205 may monitor a first operational voltage associated with the distance between the carrier sensor 220 and the first pad sensor 224*a*, a second operational voltage associated with the distance between the carrier sensor 220 and the second pad sensor 224*b*, a third operational voltage associated with the distance between the carrier sensor 220 and the third pad sensor 224*c*, and a fourth operational voltage associated with the distance between the carrier sensor 220 and the fourth pad sensor 224*d*. In one embodiment, the computer 230 compares each of these operational voltages to the initial reference voltage associated with the same pad sensor 224 to determine a voltage change associated with each of the pad sensors 224. The measured voltage change can be compared to voltage changes recorded in the database 232 and the control system 205 may control process parameters of the conditioning cycle based on these comparisons.

In one embodiment, the control system 205 will stop the conditioning cycle upon detecting a predetermined voltage differential between the initial reference voltage and the measured operational voltage associated with at least one of the pad sensors 224. As noted above, this voltage differential may be correlated to a change in thickness of the planarizing pad ($\Delta h$ in FIG. 2). In some applications, this can lead to more accurate endpointing of the conditioning cycle than might be achievable using a conventional system wherein the conditioning cycle continues for a fixed period of time without regard to the actual change in thickness of the planarizing pad 140.

In another embodiment, the control system 205 may adjust a process parameter differently in each of the regions $R_{1-4}$ depending on the operational voltages associated with the corresponding pad sensor 224*a-b*. If so desired, a process parameter may be adjusted for one region of the planarizing pad 140, e.g., the first region $R_1$, independently of any adjustment of the same process parameter for another region, e.g., the second region $R_2$. For example, the dwell time of the conditioning stone 132 in the first region as it moves along the sweep path P may be increased relative to the dwell time in the other regions $R_{2-4}$. Similarly, a downforce of the conditioning stone 132 against the planarizing pad 140 may be different in the first region $R_1$ than the downforce applied in the second region $R_2$. Changing the abrasion time or force in one region $R_{1-4}$ compared to one or more of the other regions can enable the controller 205 to achieve a more planar planarizing surface 146 than might be attained by keeping the planarizing conditions constant across the entire planarizing surface 146.

In some of the embodiments discussed above, the controller 205 employs measurements taken with the capacitance gage 212 during the abrasion process. In another embodiment, the measurements may be taken with the conditioning surface 138 spaced from the planarizing surface 146. In one exemplary method, the conditioning stone 132 is spaced a known measurement distance from the platen 120 at a first time, e.g., before the conditioning stone contacts the planarizing pad 140 to start a planarizing cycle. With the conditioning stone 132 and platen 120 spaced by the measurement distance, the capacitance gauge 212 may measure an initial voltage. The conditioning stone 132 may be rubbed against the planarizing pad 140 for at least part of the expected planarizing cycle. The conditioning stone 132 may then be spaced the same measurement distance from the platen 120 and a second voltage may be measured by the capacitance gauge 212. The difference between the initial voltage and the second voltage will provide an indication of the change in the thickness of the planarizing pad 140. In one embodiment, the second voltage is measured at the expected end of the planarizing cycle to confirm that the desired thickness of the planarizing pad has been removed. If not, the pad 140 may be further planarized. In another embodiment, the conditioning stone 132 and platen 120 are spaced from one another intermittently during the planarizing cycle and process parameters of the planarization may be adjusted if the change in measured voltage deviates from the change anticipated based on the time between measurements.

When using a conditioning machine employing multiple sensors (e.g., sensors 224*a-d*), the conditioning stone 132 may be moved along the sweep path P while spaced the same measuring distance from the platen 120, with separate measurements taken for each sensor 224*a-d*. This will enable the computer 320 to define an initial pad profile from an initial set of voltage measurements and a second pad profile from a second set of voltage measurements. By comparing the initial and second pad profiles, the computer 230 may determine the change in the thickness of the pad at various locations and a confirm that the second pad profile has the desired planarity.

When breaking in a new planarizing pad 140, the planarizing pad 140 is typically placed on the platen 120 with a dry surface. During planarizing, a fluid, e.g., water, may be delivered to the planarizing surface 146. This fluid can change the capacitance of the space between the sensors without any change in the thickness of the planarizing pad 140. In one embodiment, the impact of the fluid can be empirically determined and the computer 230 may factor out this impact when comparing the initial and second voltages or pad profiles. In another embodiment, the planarizing pad 140 and/or the conditioning stone 132 are dried to remove some or all of the planarizing fluid before taking the second voltage measurement(s). The fluid may take too long to evaporate under normal ambient conditions, though. In such a circumstance, a flow of drying gas may be directed between the pad 140 and the stone 132. In the conditioning machine 341 of FIG. 9, for example, gas from the gas supply 390 may be delivered through the gas plenum 392 to dry the planarizing pad 140.

In embodiments noted above, an initial voltage measurement (or profile) is compared to a second measurement (or profile) to determine a change in thickness. In another embodiment, a single measurement may be used to estimate a thickness of the planarizing pad 140 based on leakage current principles. For example, such a single measurement can be used to estimate an initial thickness of the planarizing pad 140 before the breaking in the pad 140. This may highlight defects in the planarizing pad 140 or the manner in which it was mounted to the platen 120 before the planarizing process begins.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. When the claims use the word "or" in reference to a list of two or more items, that word covers all of the following interpretations of the word: any of the items in the list, all of the items in the list and any combination of the items in the list.

The above detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform steps in a different order. Aspects of the invention may also be useful in other applications, e.g., in polishing or abrading workpieces other than planarizing pads or microelectronic workpieces. The various embodiments described herein can be combined to provide further embodiments.

In general, the terms used in the following claims should not be construed to limit the invention to the specific embodiments disclosed in the specification, unless the above detailed description explicitly defines such terms. While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

I claim:

1. A method of planarizing a microfeature workpiece, comprising:

spacing a carrier head carrying a microfeature workpiece a first distance from a platen carrying a planarizing pad and measuring a first voltage between a carrier sensor associated with the microfeature workpiece and a planarizing sensor associated with the planarizing pad;

positioning a surface of the microfeature workpiece against a surface of the planarizing pad;

rubbing the surface of the microfeature workpiece against the planarizing pad to planarize the surface of the microfeature workpiece;

thereafter, spacing the carrier head the first distance from the platen and measuring a second voltage between the carrier sensor and the planarizing sensor; and comparing the first and second voltages to approximate a change in thickness of the microfeature workpiece resulting from the rubbing.

2. The method of claim 1, further comprising rubbing the surface of the microfeature workpiece against the planarizing pad after comparing the first and second voltages.

3. The method of claim 1 further comprising:

adjusting a process parameter to be used during subsequent rubbing of the surface of the microfeature workpiece against the planarizing pad based on comparing the first and second voltage; and after comparing the first and second voltages, rubbing of the surface of the microfeature workpiece against the planarizing pad using the adjusted process parameter.

4. The method of claim 1 further comprising:

adjusting a process parameter to be used during subsequent rubbing of the surface of the microfeature workpiece against the planarizing pad based on comparing the first and second voltage, wherein the process parameter includes at least one of a down force of the microfeature workpiece to be applied relative to the planarizing pad and a velocity of the surface of the microfeature workpiece with respect to the planarizing pad to be used; and after comparing the first and second voltages, rubbing of the surface of the microfeature workpiece against the planarizing pad using the adjusted process parameter.

5. The method of claim 1 wherein:

the carrier sensor includes a first carrier sensor associated with a first region of the microfeature workpiece and a second carrier sensor associated with a second region of the microfeature workpiece;

spacing a carrier head a first distance from a platen carrying the planarizing pad includes spacing a carrier head a first distance from a platen carrying the planarizing pad and measuring a first voltage between the planarizing sensor and the first carrier sensor and measuring a third voltage between the planarizing sensor and the second carrier sensor;

thereafter, spacing the carrier head the first distance from the platen includes spacing the carrier head the first distance from the platen and measuring a second voltage between the planarizing sensor and the first carrier sensor, and measuring a fourth voltage between the planarizing sensor and the second carrier sensor; and comparing the first and second voltages includes comparing the first and second voltages to approximate a change in thickness of the first region of the microfeature workpiece resulting from the rubbing; and wherein the method further comprises comparing the third and fourth voltages to approximate a change in thickness of the second region of the microfeature workpiece resulting from the rubbing.

6. The method of claim 1 wherein:

the carrier sensor includes a first carrier sensor associated with a first region of the microfeature workpiece and a second carrier sensor associated with a second region of the microfeature workpiece;

spacing a carrier head a first distance from a platen carrying the planarizing pad includes spacing a carrier head a first distance from a platen carrying the planarizing pad and measuring a first voltage between the planarizing sensor and the first carrier sensor and measuring a third voltage between the planarizing sensor and the second carrier sensor;

thereafter, spacing the carrier head the first distance from the platen includes spacing the carrier head the first distance from the platen and measuring a second voltage between the planarizing sensor and the first carrier sensor, and measuring a fourth voltage between the planarizing sensor and the second carrier sensor; and comparing the first and second voltages includes comparing the first and second voltages to approximate a change in thickness of the first region of the microfeature workpiece resulting from the rubbing; and wherein the method further comprises:

comparing the third and fourth voltages to approximate a change in thickness of the second region of the microfeature workpiece resulting from the rubbing;

adjusting a process parameter to be used during subsequent rubbing of the first region of the microfeature workpiece against the planarizing pad based on comparing the first and second voltages; and after comparing the first and second voltages, rubbing the first region of the microfeature workpiece against the planarizing pad using the adjusted process parameter.

7. A method of planarizing a microfeature workpiece, comprising:

spacing a carrier head carrying a microfeature workpiece a first distance from a platen carrying the planarizing pad;

generating a first output signal from a capacitance gauge correlated to the first distance;

positioning a surface of the microfeature workpiece against a surface of the planarizing pad;

rubbing the surface of the microfeature workpiece against the planarizing pad to remove material from the surface of the microfeature workpiece;

thereafter, spacing the carrier head carrying the microfeature workpiece the first distance from the platen and generating a second output signal from the capacitance gauge; and comparing the first and second output signals to approximate a change in thickness of the microfeature workpiece resulting from the rubbing.

8. The method of claim 7, further comprising rubbing the surface of the microfeature workpiece against the planarizing pad to remove additional material from the surface of the microfeature workpiece after comparing the first and second output signals.

9. The method of claim 7 further comprising:

adjusting a process parameter to be used during subsequent rubbing of the surface of the microfeature workpiece against the planarizing pad based on comparing the first and second output signals; and after comparing the first and second output signals, rubbing of the surface of the microfeature workpiece against the planarizing pad using the adjusted process parameter.

10. The method of claim 7 further comprising:

adjusting a process parameter to be used during subsequent rubbing of the surface of the microfeature workpiece against the planarizing pad based on comparing the first and second output signals, wherein the process parameter includes at least one of a down force of the microfeature workpiece to be applied relative to the planarizing pad and a velocity of the surface of the microfeature workpiece with respect to the planarizing pad to be used; and after comparing the first and second output signals, rubbing of the surface of the microfeature workpiece against the planarizing pad using the adjusted process parameter.

11. The planarizing system of claim 7 wherein the capacitance gauge comprises a first carrier element carried by the carrier head, a second carrier element carried by the carrier head, and a planarizing sensor element carried by the planarizing pad, the first carrier element being spaced apart from the second carrier element and being associated with a first region of the microfeature workpiece, the second carrier element being associated with a second region of the microfeature workpiece, and wherein generating a first output signal includes generating a first output signal associated with the first carrier element and the planarizing element, generating a second output signal includes generating a second output signal associated with the first carrier element and the planarizing element; and comparing the first and second output signals includes comparing the first and second output signals to approximate a change in thickness of the first region of the microfeature workpiece resulting from the rubbing, and wherein the method further comprises:

prior to rubbing the surface of the microfeature workpiece against the planarizing pad, generating a third output signal from the capacitance gauge correlated to the first distance and being associated with the second carrier element and the planarizing element;

after rubbing the surface of the microfeature workpiece against the planarizing pad, generating a fourth output signal from the capacitance gauge correlated to the first distance and being associated with the second carrier element and the planarizing element; and comparing the third and fourth output signals to approximate a change in thickness of the second region of the microfeature workpiece resulting from the rubbing.

12. The planarizing system of claim 7 wherein the capacitance gauge comprises a first carrier element carried by the carrier head, a second carrier element carried by the carrier head, and a planarizing sensor element carried by the planarizing pad, the first carrier element being spaced apart from the second carrier element and being associated with a first region of the microfeature workpiece, the second carrier element being associated with a second region of the microfeature workpiece, and wherein generating a first output signal includes generating a first output signal associated with the first carrier element and the planarizing element, generating a second output signal includes generating a second output signal associated with the first carrier element and the planarizing element; and comparing the first and second output signals includes comparing the first and second output signals to approximate a change in thickness of the first region of the microfeature workpiece resulting from the rubbing, and wherein the method further comprises:

prior to rubbing the surface of the microfeature workpiece against the planarizing pad, generating a third output signal from the capacitance gauge correlated to the first distance and being associated with the second carrier element and the planarizing element;

after rubbing the surface of the microfeature workpiece against the planarizing pad, generating a fourth output signal from the capacitance gauge correlated to the first distance and being associated with the second carrier element and the planarizing element;

comparing the third and fourth output signals to approximate a change in thickness of the second region of the microfeature workpiece resulting from the rubbing;

adjusting a process parameter to be used during subsequent rubbing of the first region of the microfeature workpiece against the planarizing pad based on at least one of comparing the first and second voltages and comparing the third and fourth voltages; and after comparing the first and second voltages and comparing the third and fourth voltages, rubbing the first region of the microfeature workpiece against the planarizing pad using the adjusted process parameter.

* * * * *